US006631868B2

(12) United States Patent
Miller et al.

(10) Patent No.: US 6,631,868 B2
(45) Date of Patent: Oct. 14, 2003

(54) TAPE FEEDER WITH SPLICING CAPABILITIES

(75) Inventors: James G. Miller, Hilton, NY (US); Greg Holcomb, Rochester, NY (US)

(73) Assignee: Delaware Capital Formation, Inc., Wilmington, DE (US)

( * ) Notice: Subject to any disclaimer, the term of this patent is extended or adjusted under 35 U.S.C. 154(b) by 25 days.

(21) Appl. No.: 09/736,823

(22) Filed: Dec. 14, 2000

(65) Prior Publication Data

US 2002/0113161 A1 Aug. 22, 2002

(51) Int. Cl.[7] ..... B65H 63/08
(52) U.S. Cl. ..... 242/563; 242/563.2
(58) Field of Search ..... 242/538.2, 534, 242/563.2, 563, 564.4; 226/128, 136

(56) References Cited

U.S. PATENT DOCUMENTS

| | | | | |
|---|---|---|---|---|
| 4,327,482 A | | 5/1982 | Araki et al. | |
| 4,735,341 A | * | 4/1988 | Hamilton et al. | 221/1 |
| 4,887,778 A | * | 12/1989 | Soth et al. | 226/109 |
| 4,952,113 A | * | 8/1990 | Fujioka | 414/416.08 |
| 5,116,454 A | * | 5/1992 | Kurihara | 156/584 |
| 5,191,693 A | * | 3/1993 | Umetsu | 29/429 |
| 5,294,035 A | | 3/1994 | Asai et al. | |
| 5,531,859 A | | 7/1996 | Lee et al. | |
| 5,598,986 A | * | 2/1997 | Ando et al. | 242/597.6 |
| 5,725,140 A | | 3/1998 | Weber et al. | |
| 6,026,885 A | * | 2/2000 | Mogi et al. | 156/584 |
| 6,032,845 A | | 3/2000 | Piccone et al. | |
| 6,269,860 B1 | * | 8/2001 | Ishikawa et al. | 156/584 |
| 6,474,527 B2 | * | 11/2002 | Miller | 226/32 |

FOREIGN PATENT DOCUMENTS

| | | | |
|---|---|---|---|
| EP | 0236225 A2 | | 9/1987 |
| JP | 403212312 A | * | 9/1991 |

* cited by examiner

*Primary Examiner*—Donald P. Walsh
*Assistant Examiner*—Joseph C Rodriguez
(74) *Attorney, Agent, or Firm*—Basch & Nickerson, LLP; Duane C. Basch

(57) ABSTRACT

The present invention is a tape feeding device with splicing capabilities for reliably conveying parts to a pickup location for attachment to a substrate using a pick and place machine, including an extensible carrier tape reel support, a system for sensing the fill state of a carrier tape take-up reel, and a split hub take-up reel design to facilitate the removal of carrier tape therefrom.

4 Claims, 12 Drawing Sheets

TAPE FEEDER WITH SPLICING CAPABILITIES

CROSS REFERENCE

The following related application is hereby incorporated by reference for its teachings:

"MULTIPLE-PITCH TAPE FEEDER," James G. Miller et al., application Ser. No. 09/736,772, filed concurrently herewith, now U.S. Pat. No. 6,474,527 B2, issued Nov. 5, 2002.

This invention relates generally to the assembly of printed circuit board assemblies (PCBAs) and electronic components, and more particularly to a tape feeder device with splicing capabilities for reliably conveying parts to a pickup location for soldering to a substrate using a pick and place assembly machine.

BACKGROUND AND SUMMARY OF THE INVENTION

The present invention is a spliceable tape feeder device for reliably conveying parts to a pickup location for soldering or similar attachment to a substrate using a pick and place assembly machine. Component carrier tape used in tape feeding equipment typically comprises a plastic or similar strip having depressions at regular intervals containing the part to be mounted on the substrate and a second, plastic cover strip covering the depressions to retain the parts in the depressions during transport and use. Such tapes are generally of a limited length that is determined by the size of the components and the capacity of the fed reel that supplies the feeder. However, this invention relates to a tape feeder device that can feed such carrier tapes in a variety of formats, wherein the feeder incorporates certain functions and features that enable splicing of the feeder tape, where the need to remove the feeder from the pick-and-place system is eliminated.

The preferred method for the automated construction of circuit boards requires the use of high speed pick and place machines that pick components from a pickup location and place them at required locations on a printed circuit board for attachment. Pick and place machines rely on feeding mechanisms or feeders to reliably feed the required parts to the expected pickup location. It is well-known in the industry to package small electronic parts such as integrated circuit chips in a component carrier tape that is characterized by a flexible strip with depressions formed at regular intervals along its length. A part is disposed in each depression and secured by a cover strip that is adhered along its edges to the carrier tape. Parts that are packaged in a carrier tape require the cover strip be peeled away from the carrier tape and that the carrier tape be advanced to bring the next part to the pickup location. Normally, the cover tape is peeled back from the carrier tape at a point just prior to the pick location as the tape is advanced. In systems that are intended to enable spliceable feeding, the handling of the cover tape, after being peeled back from the carrier tape, is an important consideration. More specifically, it is important that such a feeder provides means for the storage or disposal of cover tape from a plurality of reels of carrier tape containing components.

Electronic parts are packaged in carrier tapes in a variety of formats, depending on the size of the part being delivered. In particular, carrier tapes are available in varying widths and pitches. The width is the distance from edge to edge perpendicular to the length of the tape. Widths common in the industry are 8 mm, 12 mm, 16 mm, 24 mm and larger.

The pitch of a carrier tape is the distance from one depression (e.g. lead edge) to the next (lead edge) along the length of the tape. Tapes are wound on reels and transported to the manufacturing facility. It is obvious that the part manufacturer and user will desire to use the smallest pitch tape permissible for the size of the electronic component in order to reduce the length of the tape required, thereby reducing the size and/or number of reels for the required task. Additionally, the pocket is required to be only slightly larger than the component in order to control the orientation of the component within the pocket.

In accordance with the present invention, there is provided a carrier tape feeder, comprising: a carrier tape reel support for supporting carrier tape, wherein said carrier tape reel support is extendible along a longitudinal axis of the tape feeder so as to provide access to the support during reloading of the feeder; a guide for guiding said carrier tape from a carrier tape reel to a tape guide at a pick location; and a carrier tape drive mechanism for engaging feed-holes regularly spaced along the length of carrier tape and advancing said carrier tape through said tape guide.

In accordance with another aspect of the present invention, there is provided a cover tape take-up reel, comprising: an inner flange having a tapered inner hub extending from the center thereof; an outer flange having a tapered outer hub extending from the center thereof toward the inner hub; a locking mechanism for interconnecting said inner and outer flanges wherein when the flanges are interconnected they are maintained in a generally parallel relationship, and where the inner and outer hubs, in an adjacent relationship, provide a hub suitable for winding a cover tape thereon; and where cover tape removal is facilitated by separating the outer plate from the fixed inner plate resulting in a reduced hub diameter due to the tapered outer hub.

In accordance with yet another aspect of the present invention, there is provided a system for determining the state of fill of a cover-tape take-up reel, comprising: a cover tape take-up reel disposed subsequent to a peel edge for receiving a cover tape peeled from an advancing carrier tape; take-up reel drive means for rotating said reel in association with the advancement of a carrier tape; a spring-loaded peel arm having at least one roller disposed thereon, wherein said roller is disposed between the peel edge and the take-up reel and where the cover tape is wound at least partially about the roller such that advancement of the take-up reel results in the movement of the peel arm about a pivot point; a sensor for sensing the rotation of the peel arm; a take-up reel drive controller for initiating the rotation of the take-up reel at the time of advancement of the cover tape; and a calculator for estimating the state of fill of the take-up reel as a function of the relationship between the initiation of the rotation of the take-up reel and the signal produced by said sensor.

One aspect of the invention is based on the discovery that with various improvements it is possible to produce a tape feeder that will overcome cover-tape disposal problems and will enable on-the-fly splicing and/or changing of tapes without removal from the pick and place machinery. Moreover, the various aspects of the invention, including a split-hub take-up reel, sensing of take-up reel state of fill, and an extendible carrier tape support, all facilitate the improved performance of a spliceable tape feeder. Combined with sensing of take-up reel state of fill and the split-hub reel design, the extendible carrier tape support enables the splicing of a limited number of component tapes before the feeder must be removed from the assembly system.

This aspect is further based on the discovery of techniques that facilitate the use of a single take-up reel for multiple component carrier tape reels, including the sensing of the state of fill of the take-up reel. The cover tape disposal aspect of the present invention is accomplished using a split-hub take-up reel, wherein the hub includes a keyed or locking hub to lock inner and outer hubs together, along with a tapered flange on each so as to facilitate removal when the hubs are separated. The take-up reel fill status aspect is accomplished using a peel arm and tension spring, wherein the position of the peel arm after, advance of the take-up reel, is used to accurately estimate the level to which the take-up reel has been filled. The extendible carrier tape support is preferably implemented by a slide-mounted support that, upon release of an associated latch, allows the support to be shifted relative to the feeder body and enables a user to access the rear of the feeder to install a new carrier tape without removing the feeder or interfering with adjacent feeders.

The techniques described above are advantageous because they are flexible and one or more of the techniques can be adapted to any of a number of tape feeding systems. The techniques of the invention are advantageous because they provide for changing of a component tape reel without the need to interrupt the assembly system. In addition, some of the techniques described herein can be used separately in certain situations so as to achieve similar functionality. As a result of the inventions described herein, tape feeders with improved flexibility and functionality may be produced.

Figure 1:
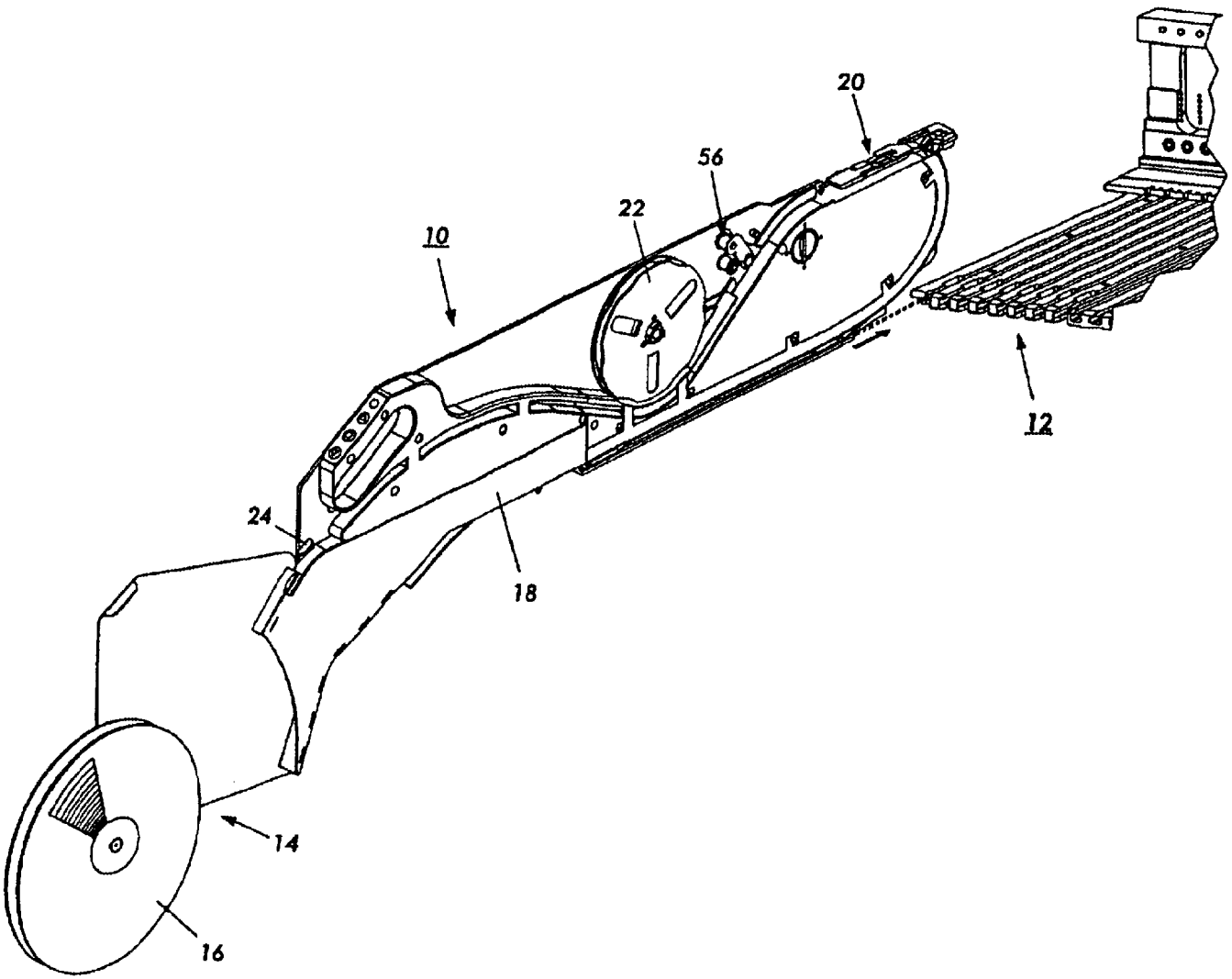
FIG. 1 is a is a general perspective view of an embodiment of the present invention in association with an interface for a pick-and-place system.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description.

"Component" is used to represent any of a number of various elements that may be automatically retrieved and applied to a printed circuit board assembly (PCBA). "Carrier tape" is intended to represent a component feeding tape having at least a component tape or base layer with punched or embedded pockets in which the components are carried, and a cover tape layer thereover to retain the components within the pockets during transport and use of the tape. Carrier tapes come in various widths, depending upon component size and are typically in the range of 8 to 56 mm. The parallel edges of the cover tape are affixed to the carrier layer using an adhesive or thermal process so that the cover tape generally remains attached to the carrier layer when the component carrier tape is wound on a reel for ease of transportation and use. As noted above, the carrier tapes also come in multiple widths.

Turning now to the drawings, FIG. 1 is a perspective illustration of a spliceable feeder 10 being inserted into a receiving interface 12 of a pick-and-place assembly system (cut-away only). As will be appreciated by those familiar with tape feeders and assembly systems, it is common to utilize a plurality of tape feeders positioned adjacent one another in the receiving interface so as to permit the feeding and assembly of a plurality of components onto the printed circuit boards. It will be further appreciated that any opportunity to reduce the numbed of feeders required, or to reduce the need to remove a feeder from the pick and place assembly system, will further reduce the overall cost of operating such a system. For example, aspects of the present invention will extend the frequency of changing out a take-up reel from once for each new component tape reel to once for approximately every five component tape reels.

Feeder 10 preferably includes a carrier tape support 14 supporting a carrier tape reel 16. Tape from reel 16 is fed through a tape path in the body 18 of the feeder. Ultimately, the carrier tape is fed through a tape window at pick location 20, where the cover tape is peeled away and the carrier tape is advanced so that components may be removed therefrom. The cover tape is then wound about take-up reel 22. As further illustrated in FIG. 1, the feeder includes a latch 24 that allows the feeder to be unlocked from the receiving interface when necessary for removal.

Figure 2:
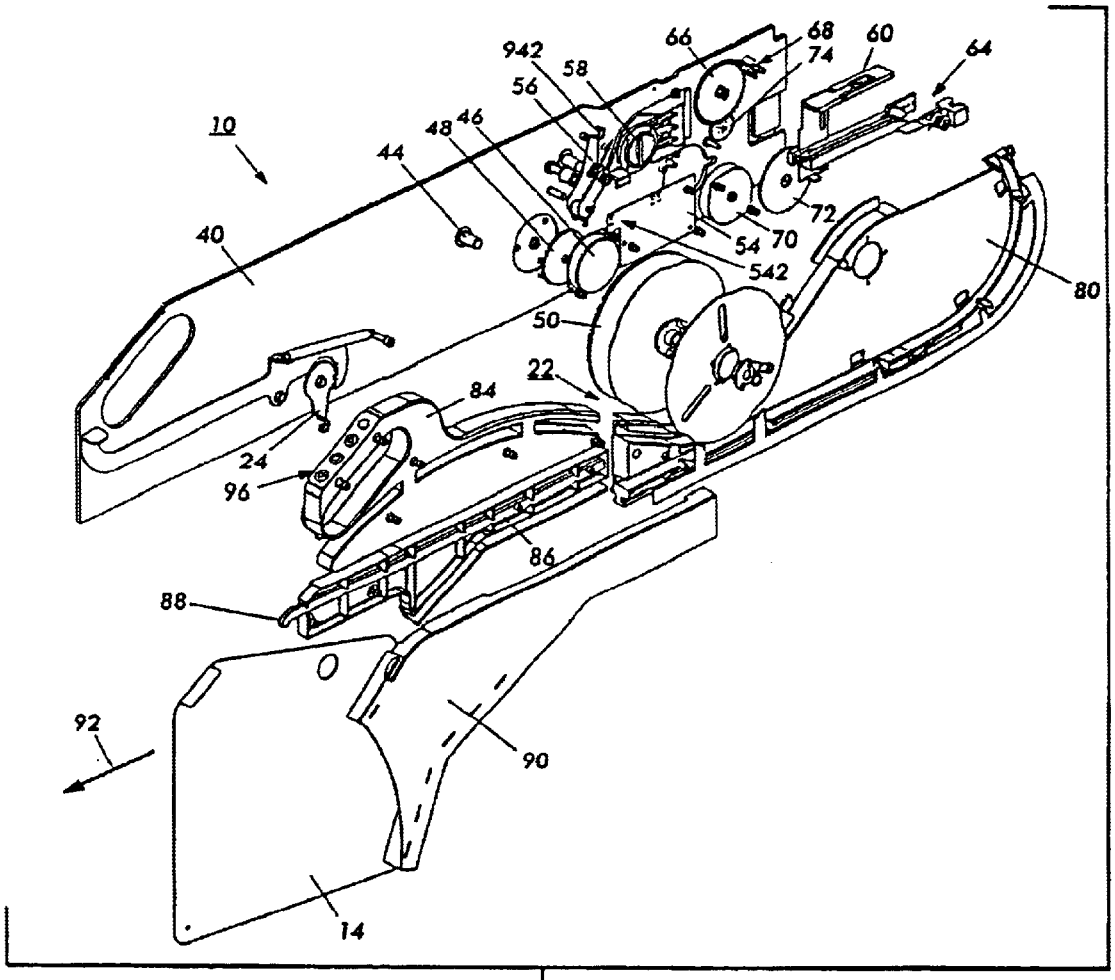
FIG. 2 is a detailed perspective view of the various components and assemblies of an embodiment in accordance with the present invention.

Referring next to FIG. 2, displayed therein is an assembly drawing depicting the various components in an embodiment of the spliceable feeder 10. Feeder 10 is assembled upon a rigid metal base plate 40 that includes a mounting surface for latch assembly 24. Extending from base plate 40 is a post 44 to which the split-hub take-up reel 22 is mounted. As will be further described, take-up reel 22 is driven by a stepper drive motor 46, driving a gear or pulley 48 that is directly coupled with take-up reel drive gear or pulley 50. It will be appreciated that alternative drive mechanisms may be employed for the take-up reel, however, as will be described below a direct drive system is preferred for certain aspects of the present invention.

Feeder control hardware and software is present on board 54, which is operatively associated with peel arm assembly 56 and cammed selection knob 58 via optical sensors as will be described below. Cammed selection knob 58 also slidably adjusts a tape window 60 relative to a front locator assembly 64 in a multi-pitch feeder configuration as described, for example, in the co-pending application cross-referenced above. Front locator assembly 64 also serves to hold carrier tape in position with respect to toothed drive sprocket 66. In one embodiment, sprocket 66 is directly advanced or reversed under the control of stepper drive motor 70 and gears 72 and 74. While the position of the sprocket may be controlled via the stepper motor, operation or position of the sprocket is preferably monitored via sensor 68, which is positioned so as to sense an optically encoded ring (equivalent to a 2 mm pitch) about sprocket 66.

The various drive and control components described above are covered by a front cover 80 that includes a tape feed path or guide along the top thereof and a carrier tape disposal path or guide along the bottom thereof. At the rear (left side) of the feeder is a rear cover/tape guide 84 that includes a slide 86 and slide latch 88. Attached to slide 86 is tail-stock 90 that includes carrier tape support 14, wherein the depression of slide latch 88 allows a user to slide the tail stock 90 and carrier tape support 14 in the direction indicated by arrow 92. Accordingly, carrier tape reel support is extendible along a longitudinal axis of the tape feeder. Such a feature allows the carrier tape support to be accessed even while the feeder is positioned within the pick and place machine with adjacent feeders.

It will be further appreciated that equivalent carrier tape supply means (e.g., access to component carrier tape) may be provided by basket-type carrier tape reel holders, where reel 16 is constrained within a nest yet allowed to rotate. The basket-type carrier will allow for the removal and access to the component carrier tape from the rear of the feeder, thereby allowing splicing of additional component carrier tapes.

Figure 3:
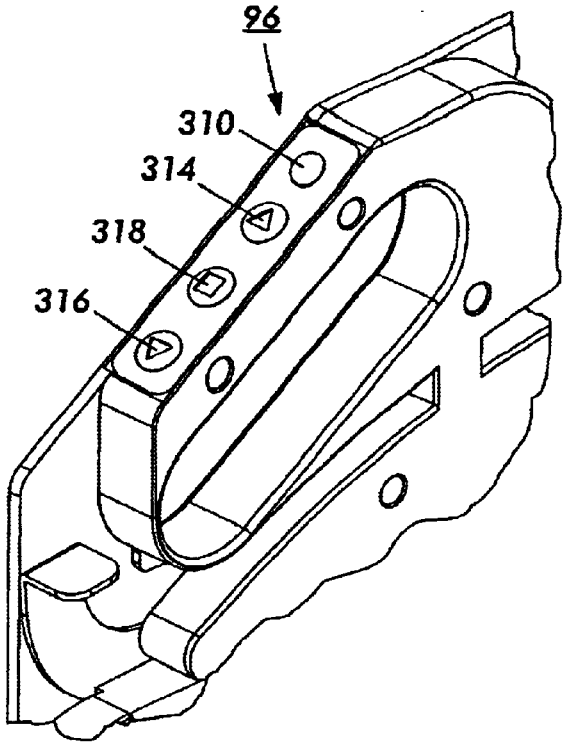
FIGS. 3–7 are detailed illustrations of various components and assemblies in accordance with aspects of the present invention.

Also present along a handle portion of rear cover/tape guide 84 is a handle 96 that is further illustrated in FIG. 3. Handle 96 also includes a forward feed button switch 314 that advances the carrier tape by a distance equal to the selected tape pitch. Similarly, reverse feed button switch 316 that retracts or reverses the carrier tape by a distance equal to the selected tape pitch. Lastly, single hole feed switch 318, when depressed in conjunction with switch 314 or 316 advances the carrier tape by a single drive pitch (e.g., 2 mm). Handle 96 may also include one or more indicator lights (e.g., light-emitting diodes) that indicate the status of the feeder. For example, the level of fill of the take-up reel 22 may be indicated, where a flashing indicator signals an almost full condition and a continuous indicator indicates the take-up reel is full and the feeder has stopped.

Figure 4:
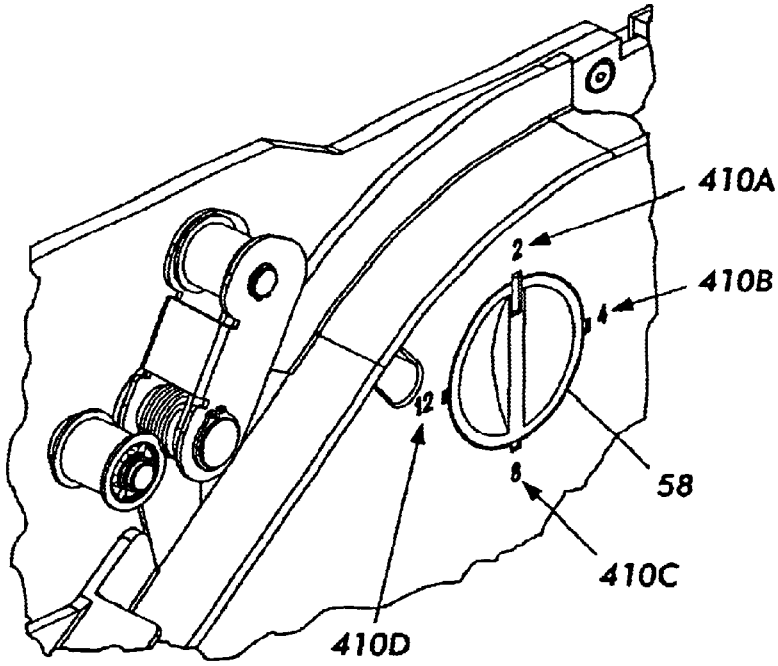

Referring next to FIG. 4, the operation of the cammed, pitch-selector knob will be briefly described. As depicted in FIG. 4, pitch selector knob 58 may be rotated so as to be positioned in one of four pitch selection positions 410*a*–410*d*, respectively representing 2 mm, 4 mm, 8 mm and 12 mm pitch selections in one spliceable feeder embodiment.

Figure 5:
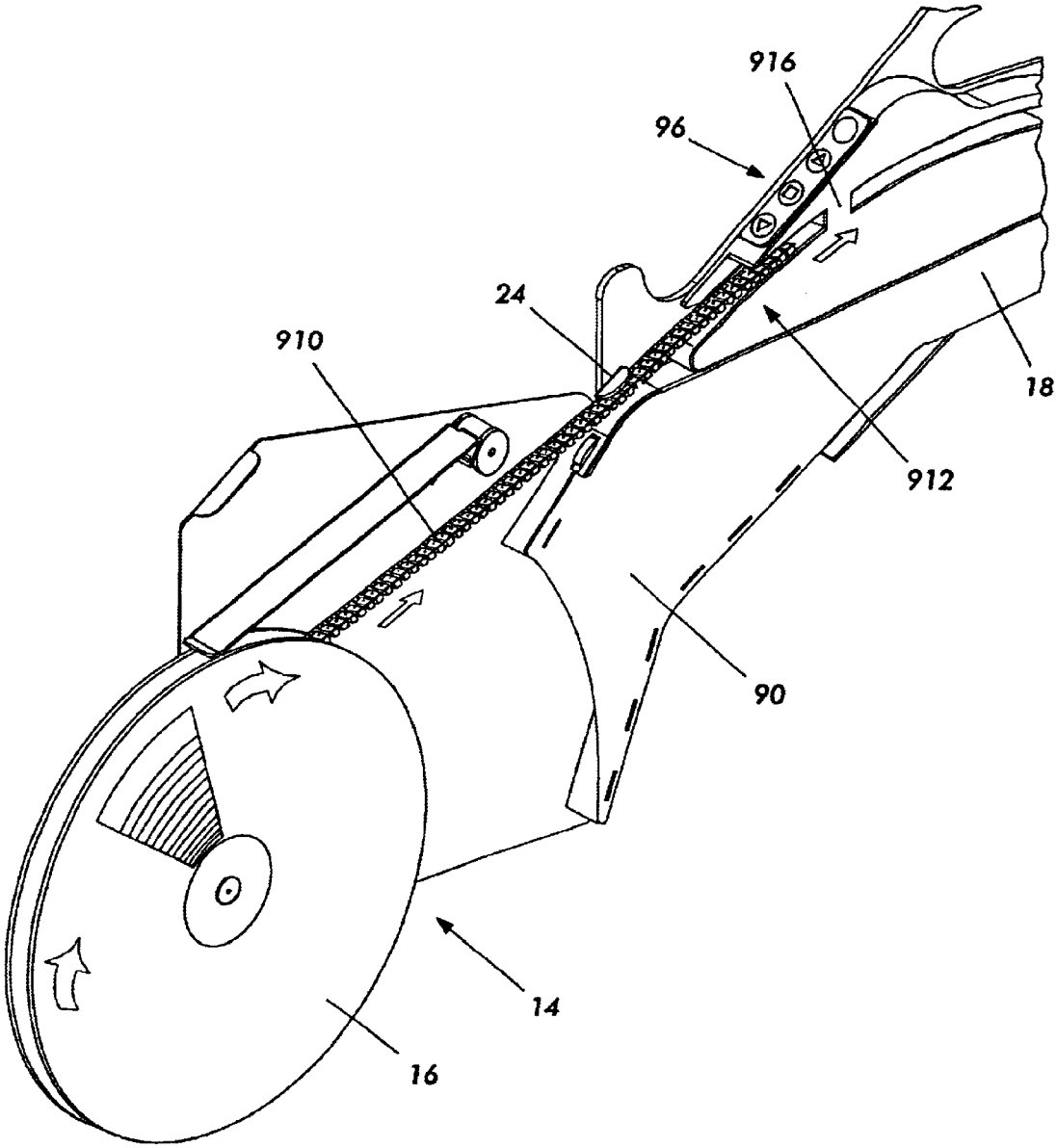
Figure 6:
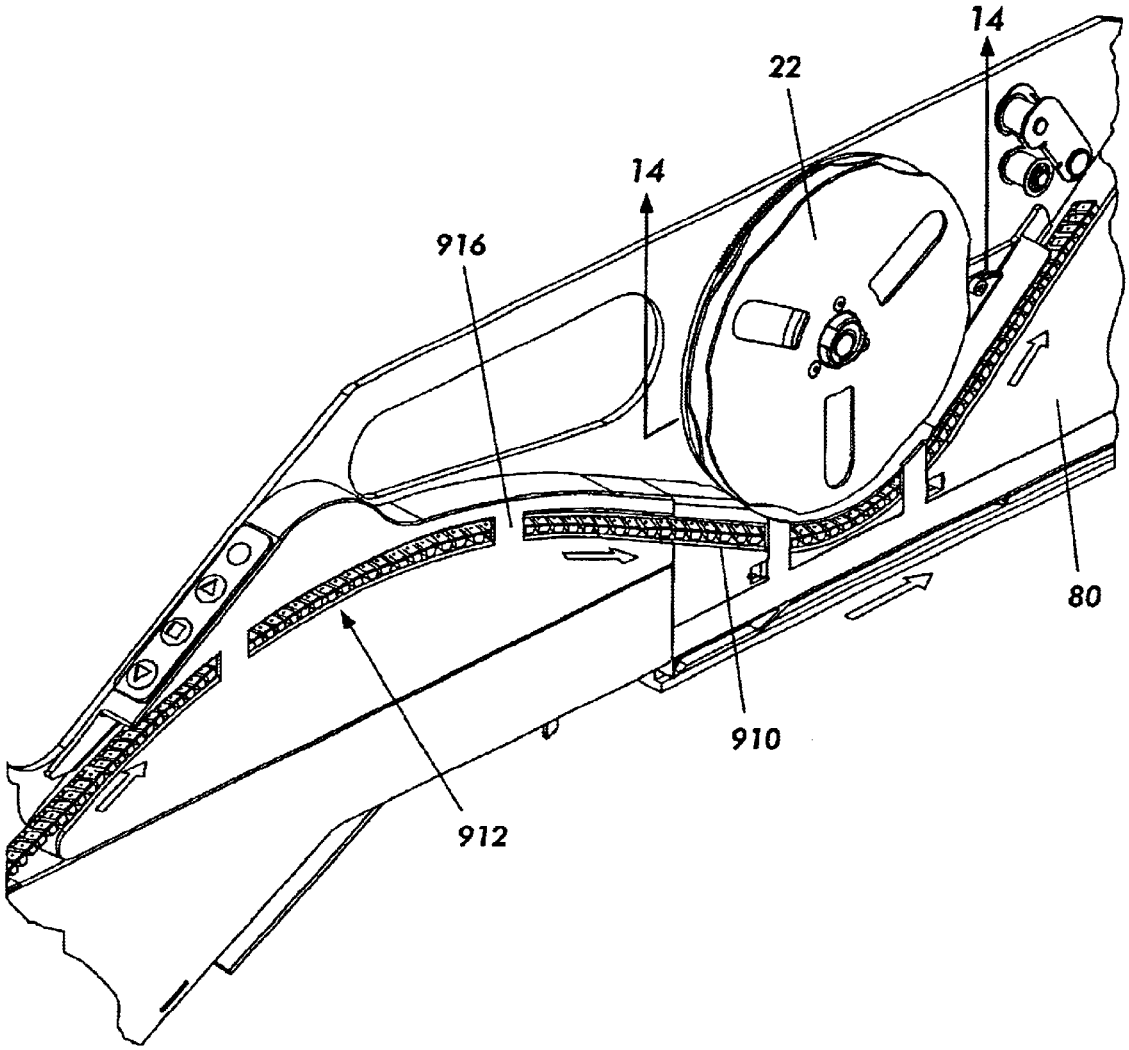
Figure 7:
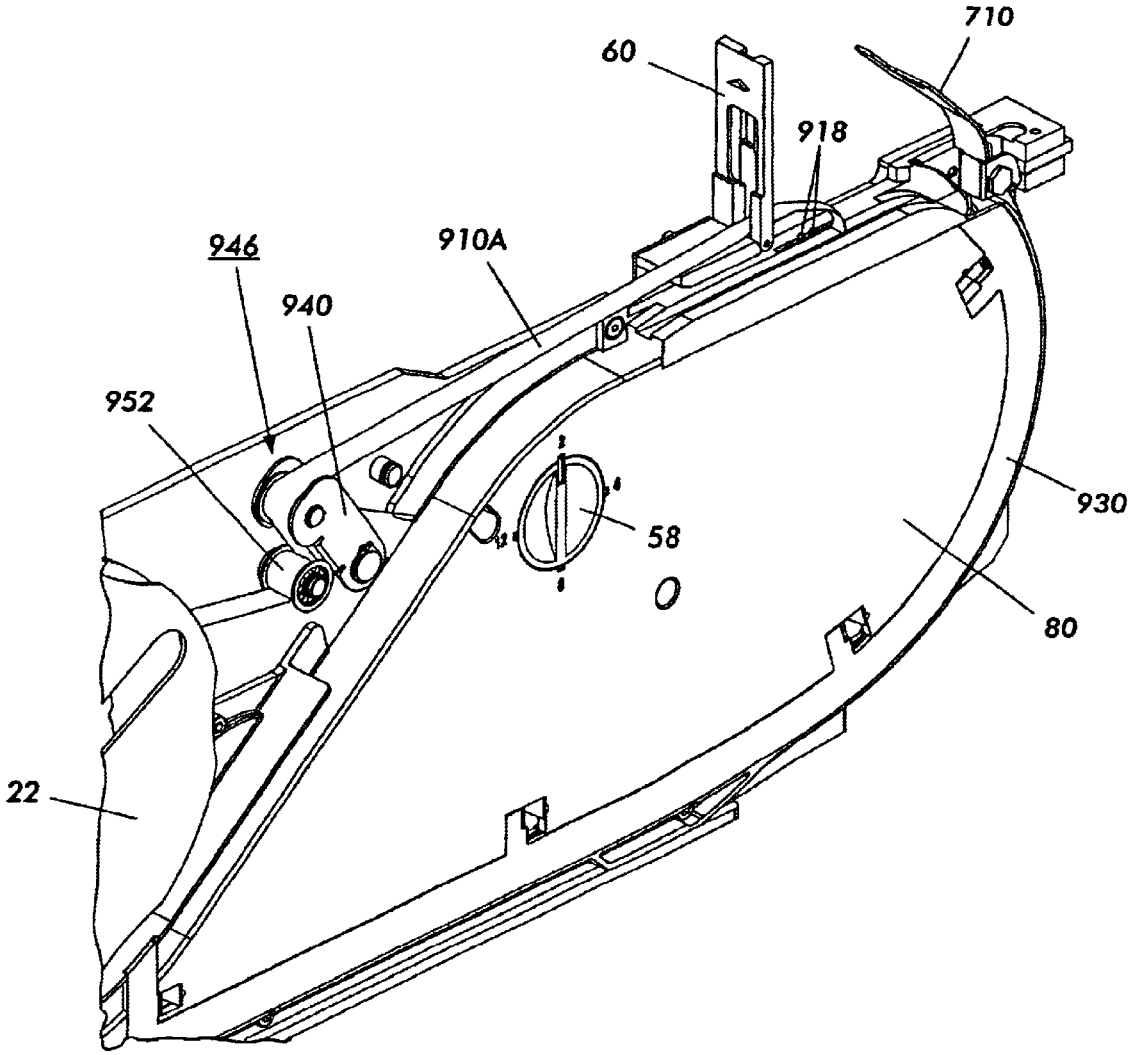

Referring next to FIGS. 5–7, there will be described the method of loading or threading a carrier tape in the system, as well as the operation of the various components of the spliceable feeder in accordance with the present invention. Initially, and possibly with the carrier tape reel support 14 extended, a carrier tape reel is attached to the reel support in a manner such that tape 910 feeds from the reel at the top and where the reel rotates in a clockwise direction while paling out tape, as indicated by the arrows. Tape 910 is then threaded below the latch handle 24 and into the upper tape path or guide 912 where it is retained within the open upper tape path by a plurality of vertical members 916.

As further depicted in FIG. 6, carrier tape 910 is continuously fed through the upper tape path 912 in the feeder front cover 80, in a direction toward the tape window and pick location as indicated by the arrows. Referring briefly to FIG. 7, at the tape window, the carrier tape is engaged with teeth 918 of the drive sprocket. When the carrier tape reaches the pick location 920 defined within tape window 60, the window latch 710 is released and the cover tape 910*a* is peeled back from the carrier tape 910 for at least a length thereof.

As carrier tape 910 is further advanced, it is directed into the exit or discharge chute or path 930 that, as previously described, extends along the lower perimeter of the front cover. The cover tape 910A is then further fed through peel arm assembly 56, which preferably includes a bracket 940 having an arm or flag 942 extending therefrom. Bracket 940 is designed to pivot, under spring tension, about point 946, so that pulleys or wheels 950 and 952 remain in contact with the cover tape and maintain tension thereon as the carrier tape is advanced past the peel edge. Flag 942 serves to interrupt or trigger optical sensor 542 (shown in FIG. 2) as the peel arm assembly is pivoted, and is employed in the estimation of the state of fill of take-up reel 22 as will be further described below.

Referring also to FIG. 7, once the cover tape 910*a* is threaded through the peel arm assembly, it is passed through an outer hub of the take-up reel 22 and affixed thereto by pinching it between the inner and outer hubs when assembled. The take-up reel is then installed on its drive hub (not shown) and the cover tape is manually tightened.

Figure 8:
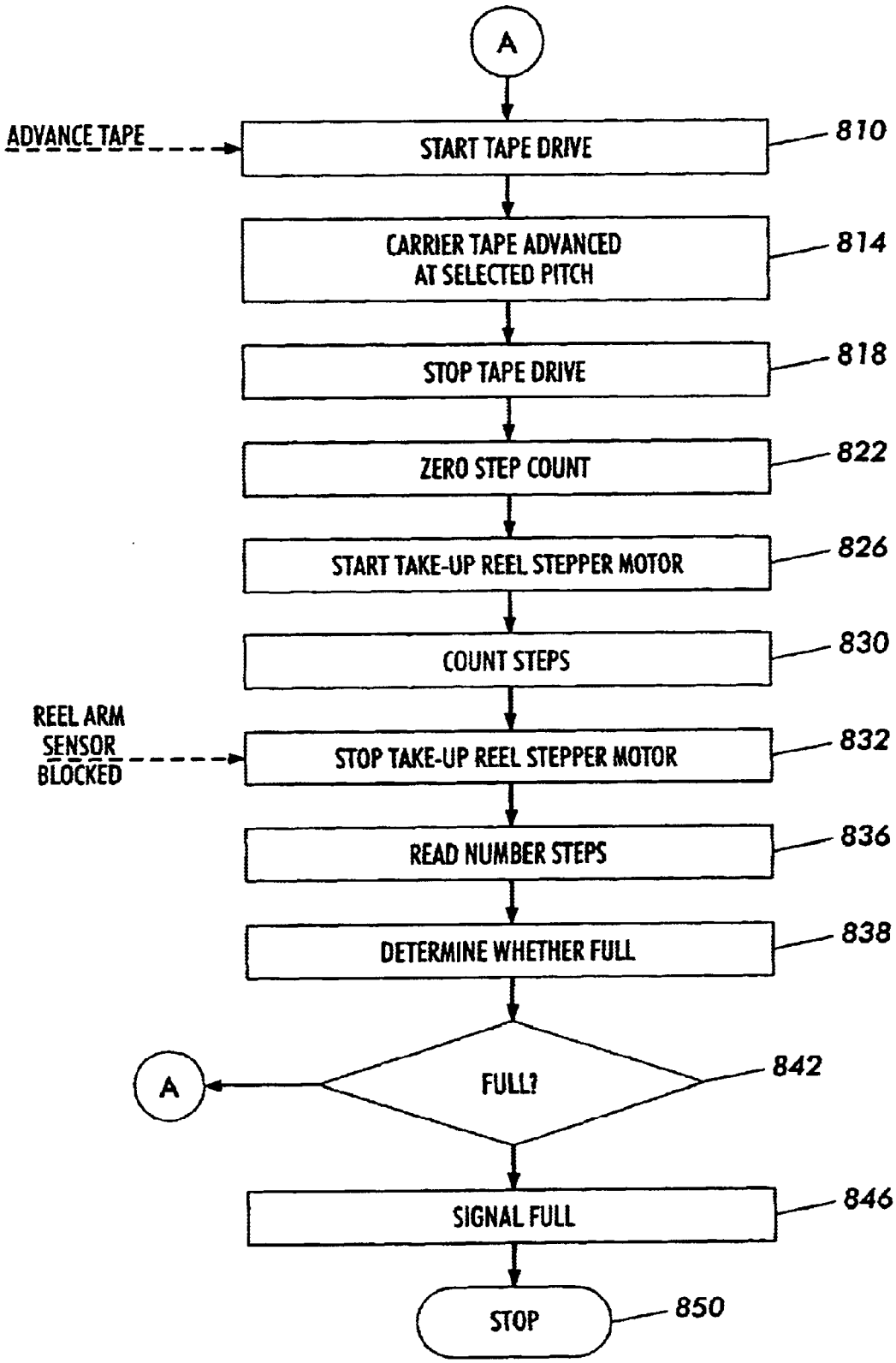
FIGS. 8 and 9 are flowcharts depicting the operation of a take-up reel state determining method in accordance with an aspect of the present invention.

Turning next to FIG. 8, the flowchart depicted therein will be used to describe the method employed to sense the fill state of the cover tape take-up reel. Under normal operating conditions, the advance of the carrier tape is controlled in sequence with the retrieval of components from the pick location. In other words, the carrier tape is advanced a distance determined by the selected pitch only after a component has been retrieved therefrom. Accordingly, the flowchart of FIG. 8 illustrates the general steps of a single feeder cycle, as initiated by an "Advance Tape" signal from the pick and place machine. One embodiment employs a MicroChip® microcontroller for control of the various functions of the spliceable feeder, although it will be appreciated that a number of other microprocessors or microcontrollers may be similarly utilized to control the spliceable feeder and synchronize its operation with the pick and place machinery.

When the Tape Advance signal is received, the cycle begins at step 810, where the carrier tape drive stepper motor is started. Under the control of a microprocessor, the drive is advanced a predefined number of steps or until the optical encoder on the tape drive sprocket indicates that the carrier tape has been advanced by the selected pitch at step 814 (e.g., 2 mm, 4 mm, 8 mm, 12 mm). Subsequently the carrier tape drive is stopped, step 818, and a register or counter on control board 54 is zeroed at step 822. Next, stepper motor 46 is energized and the take-up reel is advanced while the number of steps are counted at step 830. The take-up reel stepper motor continues to advance the take-up reel until the controller receives a signal from the peel arm flag sensor 542, indicating that the peel arm has again reached its full-tension position (has been rotated clockwise as a result of the take-up reel tensioning the cover tape) as indicated by the "Peel Arm Sensor Blocked" signal at step 832 where the take-up reel stepper motor is stopped.

Once the take-up reel has been stopped, the microcontroller can read the number of steps from the counter, step 836, and can use that number to determine whether the take-up reel is full as will now be described. Recognizing that the amount of cover tape material that is wound by the take-up reel by a given change in its angular rotation is dependent upon the amount that the reel is filled, it is possible to determine the state of fill. For example, when the feeder is operating in a 2 mm pitch mode the stepper motor (preferably operating in a constant-velocity pulse mode) advances the take-up reel until the peel arm optical sensor is occluded. The lower the level of fill, the more steps necessary to take up the cover tape.

Figure 9:
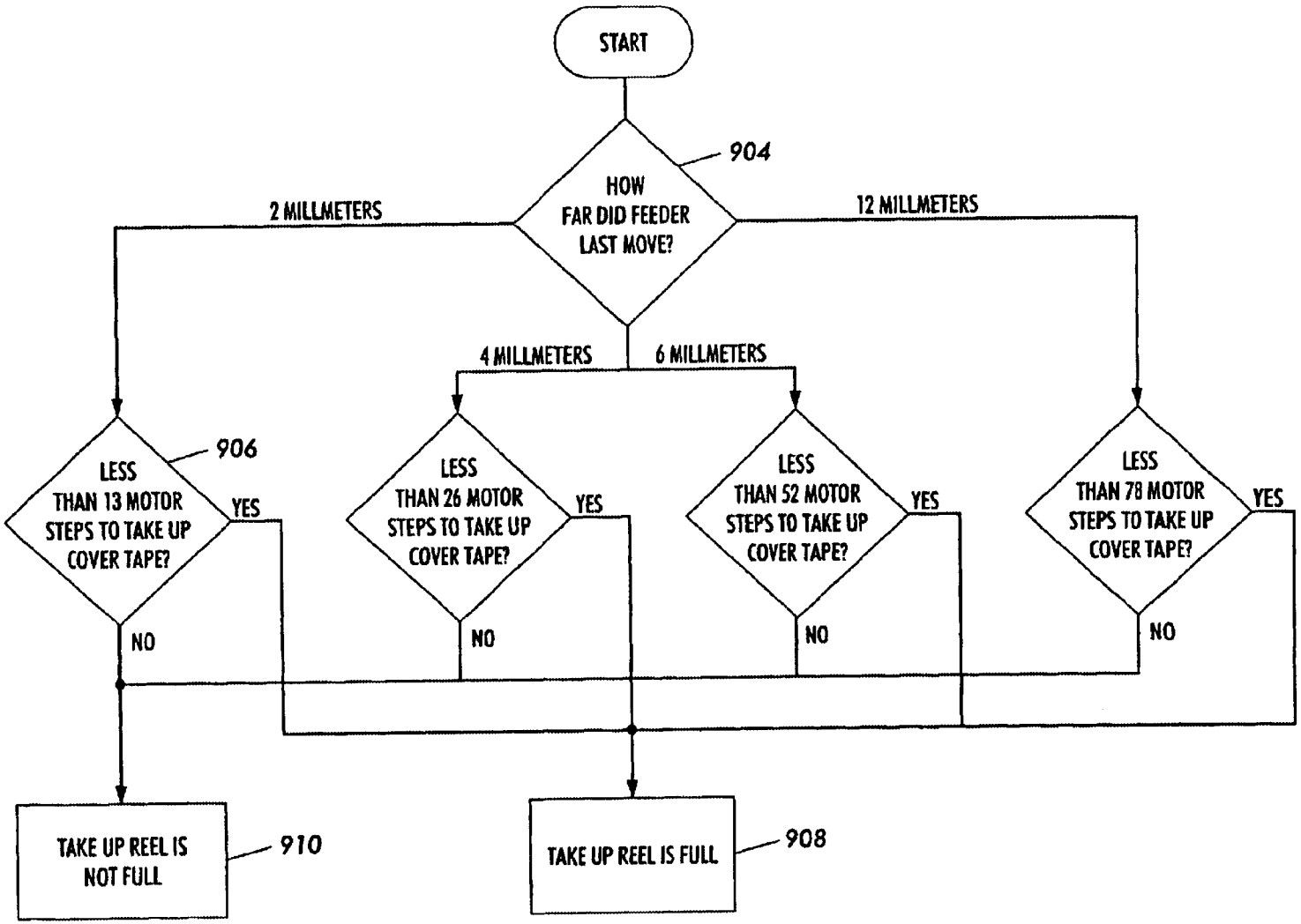

As illustrated by the decision flow-chart of FIG. 9 (based upon empirical data), step 904 determines the feeder distance at step 904. It will be appreciated, that this step may be eliminated in a single-pitch feeder embodiment. Using the pitch, the anticipated length of cover tape is determined, and is translated into the number of cover tape take-up reel drive steps needed to re-tension the cover tape. As represented by decision block 906, if the take-up reel requires thirteen or fewer steps to take up the cover tape slack, then the reel has reached at least about ninety percent of its capacity and the take-up reel is full (step 908), otherwise the reel is not full (step 910). Similar testing is carried out for other pitch sizes as indicated in FIG. 9. Accordingly, the following table is utilized by the controller software to determine when the take-up reel has reached its capacity:

| Selected Pitch (mm) | # Steps when at Capacity |
|---|---|
| 2 | 13 |
| 4 | 26 |
| 8 | 52 |
| 12 | 78 |

Referring again to FIG. 8, using the above algorithm, the system determines, at step 838, whether the take-up reel is full. As indicated by decision block 842, if the take-up reel is not full then the cycle is complete and the feeder returns to "A" where it awaits a subsequent Advance Tape signal. Otherwise, the reel is full and the process continues with step 846 where an operator is signaled that the reel is full (via communication with the pick and place equipment and/or via an indicator light on the feeder) and cycle is stopped at 850. In an alternate embodiment, step 908 may be carried out over multiple tape advances, wherein a predefined consecutive number of advances must result in a "full" signal (less than prescribed number of steps) in order to trigger the operator signal. It will be appreciated that such an alternative embodiment avoids false or early "reel full" signals.

In general, the take-up reel state algorithm may be expressed as a ratio between the number of steps by the cover tape advance drive motor and the pitch of carrier tape advance distance. In other words, the reel has reached a full state when Cover Tape Winding Steps÷Carrier Tape Pitch X, where X is an empirically determined value that relates the geometry of the take-up reel and the tape idler system (including the idler tension spring). In the embodiment described herein, X equals 6.5, however it will be appreciated that other geometries may be used to arrive at the fill threshold value that is then "programmed" into the system software.

Figure 10:
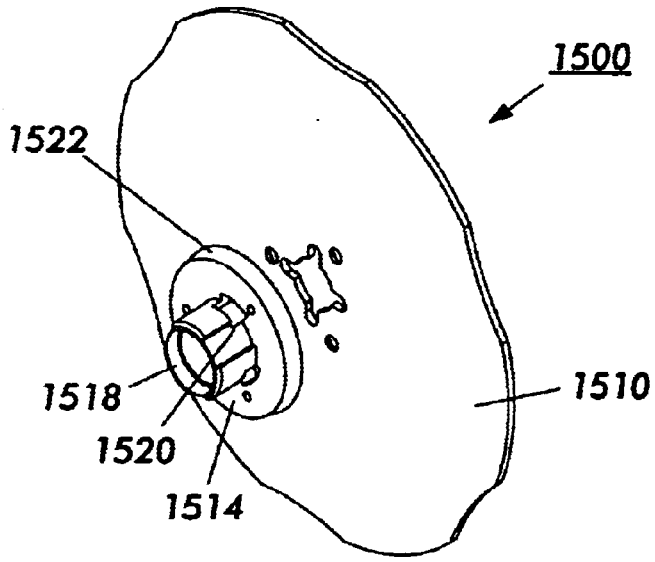
FIGS. 10–14 are detailed illustrations of split-hub take-up reel embodiments in accordance with the present invention.
Figure 11:
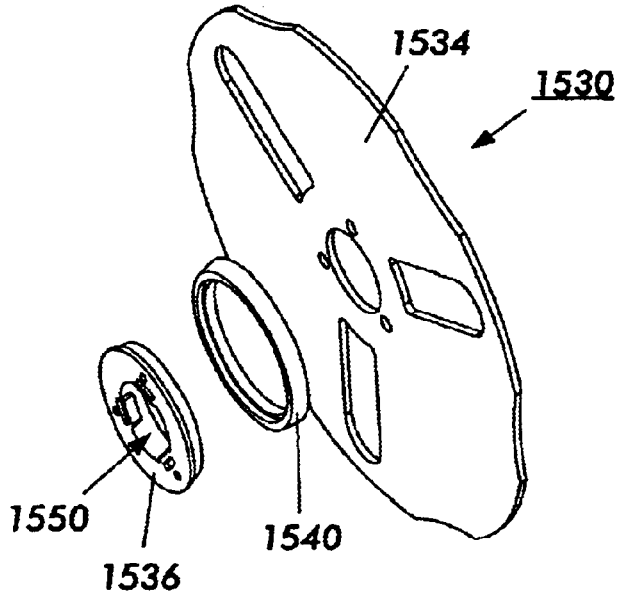

Considering FIGS. 10 and 11, respectively depicted therein are the inner and outer assemblies for the take-up reel employed in an embodiment of the present invention. In particular, FIG. 10 illustrates inner assembly 1500 which includes a flange 1510 that has an inside hub 1514 attached thereto. As illustrated in the figure, hub 1514 has a cylindrical central hub 1518 that has a releasable bayonet mount feature 1520 thereon. The outer lip 1522 of hub 1514 also has a tapered surface, wherein the diameter of the lip is greater at the edge adjacent flange 1510 and smaller on the non-adjacent edge.

Similarly, FIG. 11 depicts outer take-up reel assembly 1530. The assembly includes a flange 1534, a bayonet slip hub 1536 and a tapered hub 1540 sandwiched therebetween. In particular, tapered hub 1540 has a tapered surface, wherein the diameter of surface is greater at the edge adjacent flange 1534 and smaller on the non-adjacent edge. As will be appreciated the inner and outer assemblies may be assembled by inserting the cylindrical central hub 1518 of the inner assembly within the opening 1550 of the outer assembly and twisting the assemblies relative to one another to engage the bayonet lock. Doing so with a portion of cover tape sandwiched therebetween will assure that the tape cannot be removed until releasing the bayonet lock parts the assemblies.

Figure 12:
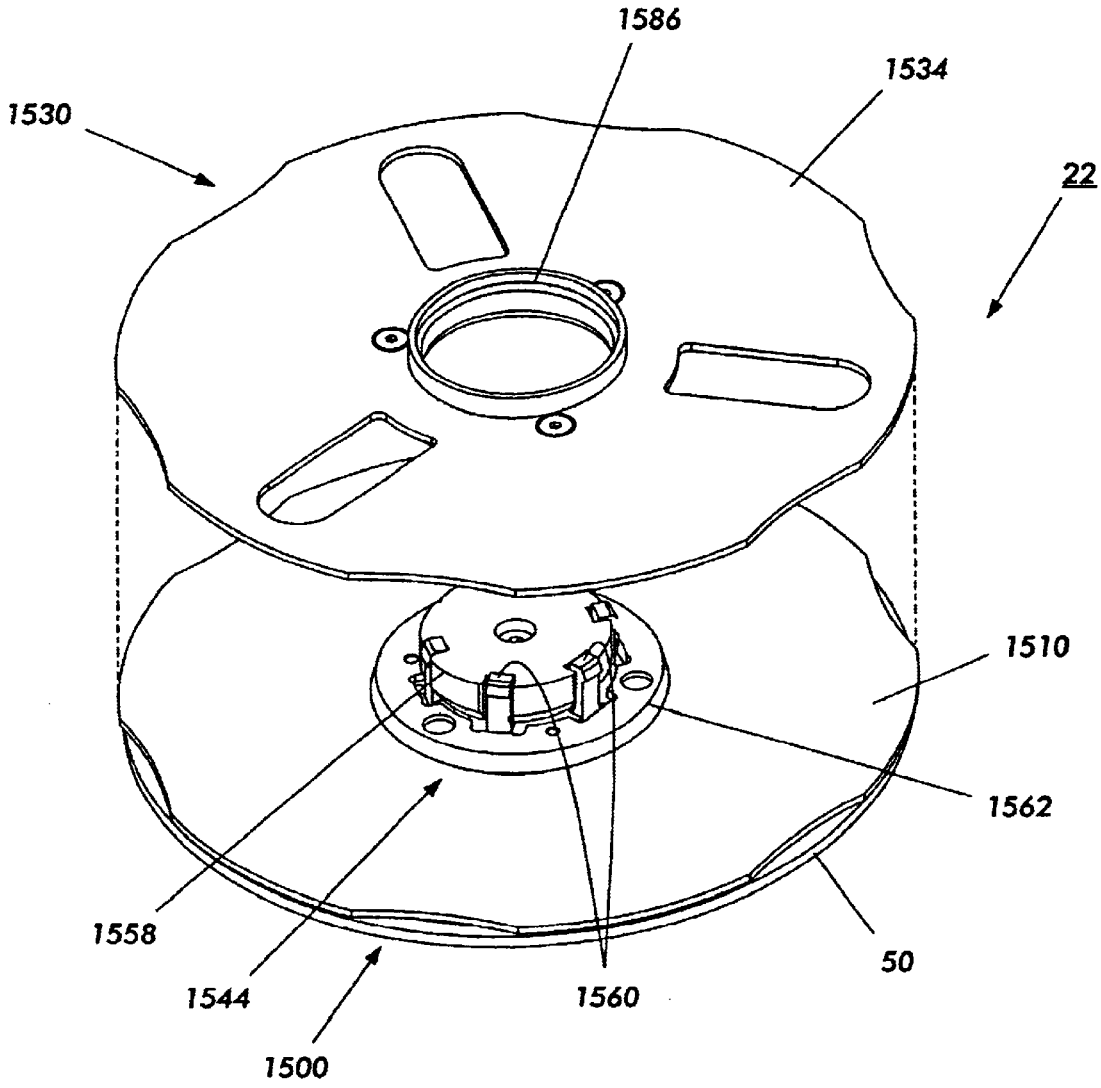

Referring to FIG. 12, there is depicted a preferred embodiment of the tapered, split-hub configuration. In particular, the split hub of the preferred configuration also includes inner assembly 1500. Assembly 1500 further includes a flange 1510 that has an inside hub 1554 attached thereto. As illustrated in the figure, hub 1554 has a cylindrical central hub 1558 that has a releasable tab mount feature 1560 thereon. The outer lip 1562 of hub 1544 also has a tapered surface, wherein the diameter of the lip is greater at the edge adjacent flange 1510 and smaller on the non-adjacent or interior edge.

Figure 13:
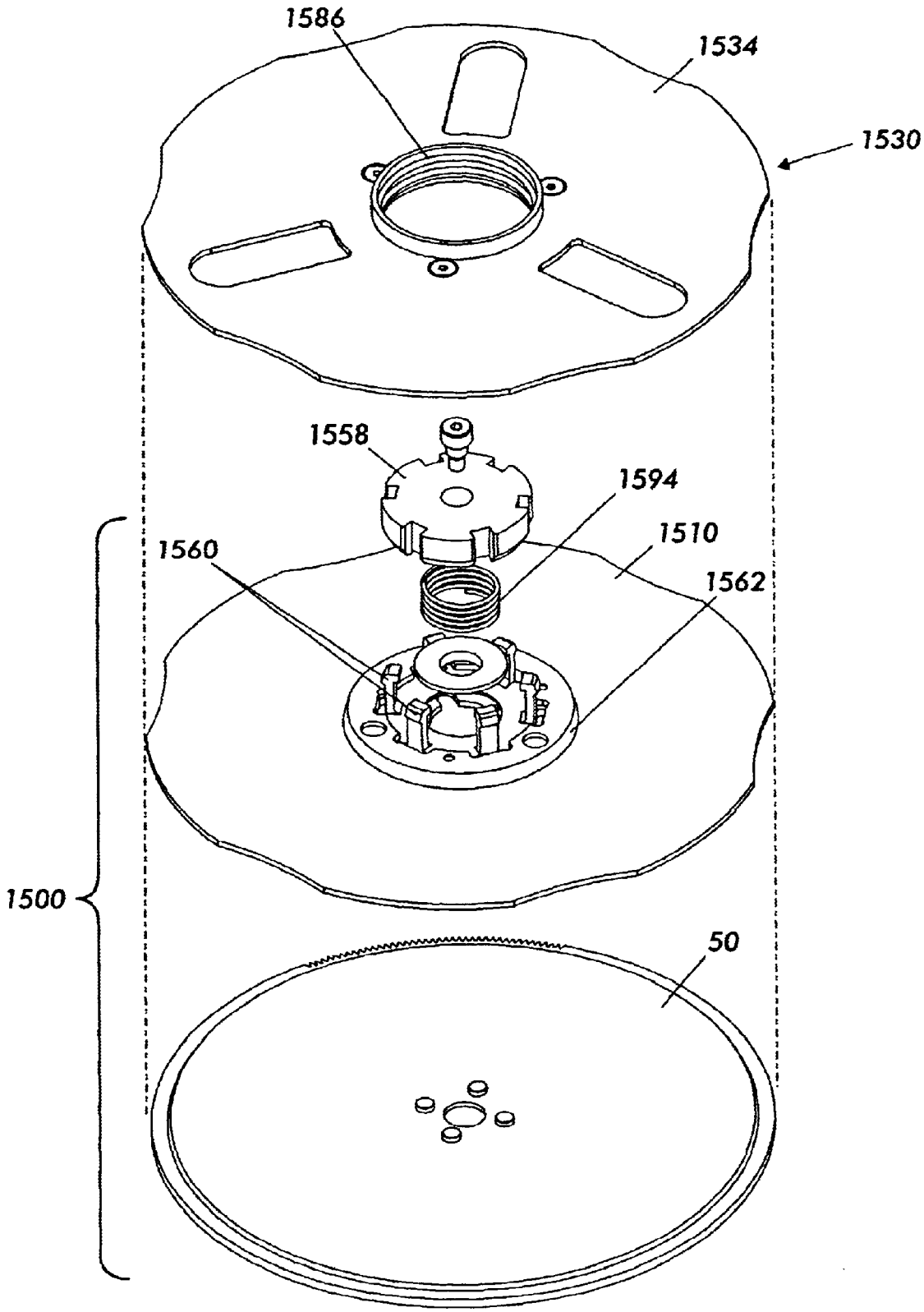
Figure 14:
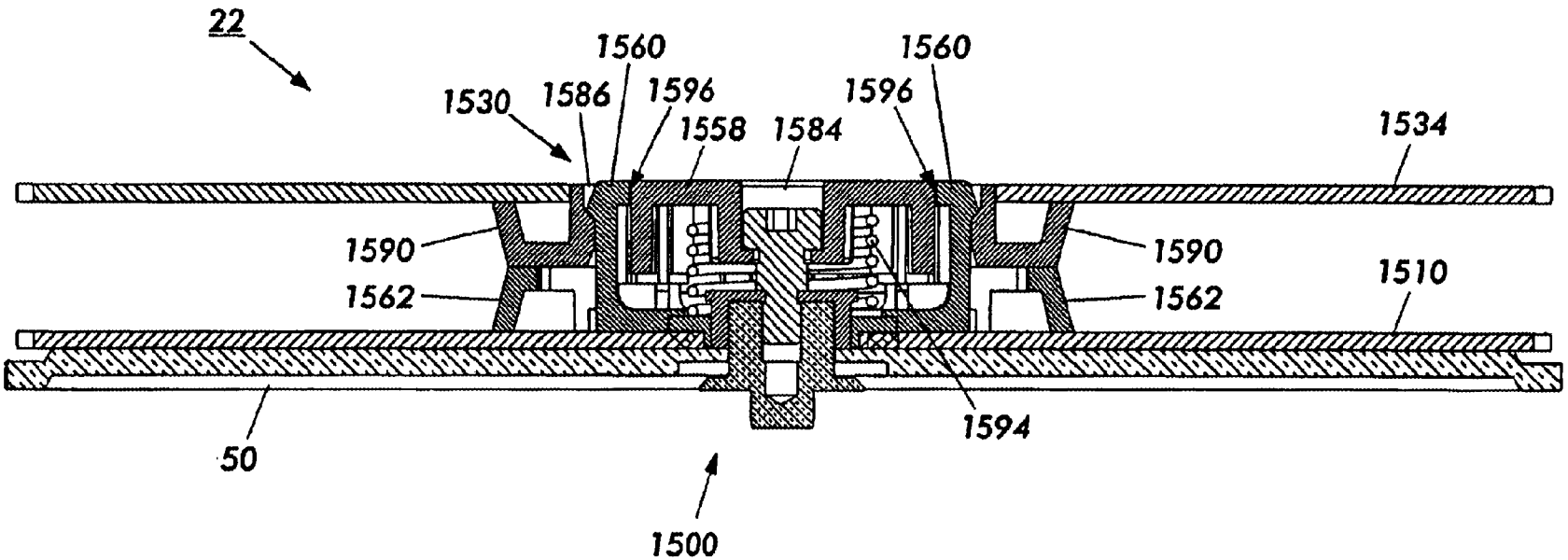

Also depicted in FIG. 12 is outer take-up reel assembly 1530. The assembly includes a flange 1534, a ridged inner hub 1586 and a tapered outer hub 1590. In particular, tapered hub 1590 has a tapered surface, wherein the diameter of surface is greater at the edge adjacent flange 1534 and smaller on the non-adjacent edge. As will be appreciated, the inner and outer assemblies may be assembled by inserting the cylindrical central hub 1558 of the inner assembly within the opening of the ridged inner hub 1586 such that releasable tabs 1560 grasp the inner, ridged hub 1586 and so as to releasably engage the assemblies 1530 and 1500. Referring also to FIG. 14, it will be appreciated that once the assemblies 1530 and 1500 are assembled and affixed via the tabs 1560, the tabs are locked in place by the inner cylindrical hub 1558 that is affixed to assembly 1500 by machine screw 1584. To release the outer flange assembly from the inner flange assembly (e.g., when necessary to unload wound cover tape), the user would push cylindrical hub 1558 so as to compress spring 1594, thereby causing cylindrical hub to move out of contact with the inner surface 1596 of tabs 1560. When the cylindrical hub is depressed, the outer flange may be pulled apart from the inner flange as the angled inner ridges on hub surface 1586 will not provide sufficient resistance to parting of the flanges. It will be appreciated that the split-hub design depicted in FIGS. 12–14 does not require the rotation of the hubs relative to one another in order to separate the hubs for disposal of the spent cover tape.

It will be appreciated by those familiar with component feeders and cover tape take-up systems that the split-hub embodiments described herein, particularly the tapered hub surfaces, provide a significant advantage when it is necessary to remove the cover tape therefrom. In particular, the cover tape having been tightly wound on the take-up reel is typically removed by unwinding the reel in a separate manual or automated process. However, the split-hub designs allow the reel to be disassembled once removed from the feeder. Furthermore, the tapered surfaces allow the center of the wound cover tape to collapse once the flange assemblies are separated, thereby facilitating removal from the hub without unwinding or cutting the tape therefrom.

In recapitulation, the present invention is a tape feeder device with splicing capabilities for reliably conveying parts to a pickup location for attachment to a substrate using a pick and place machine, including an extensible carrier tape reel support, a system for sensing the state of a carrier tape take-up reel, and a split hub take-up reel design to facilitate the removal of carrier tape therefrom.

It is, therefore, apparent that there has been provided, in accordance with the present invention, a tape feeder with splicing capabilities for reliably conveying parts to a pickup location. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A carrier tape feeder, comprising:

a carrier tape reel support for supporting carrier tape;

a guide for guiding said carrier tape from a carrier tape reel to a tape guide at a pick location;

a carrier tape drive mechanism for advancing said carrier tape through said tape guide;

a peel edge for peeling a cover tape from a surface of the carrier tape;

a cover tape take-up reel disposed subsequent to said peel edge for receiving a cover tape peeled from the surface of the advancing carrier tape;

a system for determining the state of fill of the cover tape take-up reel, including:

a take-up reel drive motor for rotating said cover tape take-up reel in association with the advancement of a carrier tape;

a spring-loaded peel arm having at least one roller disposed thereon, wherein said roller is disposed between the peel edge and the take-up reel and where the cover tape is wound at least partially about the roller such that advancement of the take-up reel results in the movement of the peel arm about a pivot point;

a sensor for sensing the rotation of the peel arm;

a take-up reel drive controller for initiating the rotation of the take-up reel at the time of advancement of the cover tape; and a calculator for estimating the state of fill of the take-up reel as a function of the relationship between the initiation of the rotation of the take-up reel and the signal produced by said sensor.

2. The carrier tape feeder of claim 1, wherein said spring-loaded peel arm includes a flag arm extending therefrom and where said sensor is an optical sensor for sensing the flag arm when said peel arm has pivoted through a predetermined angle of rotation.

3. The carrier tape feeder of claim 1, wherein said calculator estimates the state of fill by performing steps comprising:

determining the carrier tape pitch of the feeder;

counting a number of steps of advancement of the take-up reel drive means between initiation of the rotation of the take-up reel and the signal produced by said sensor;

dividing the number of steps of advancement of the take-up reel drive means by the carrier tape pitch to create a result; and determining that the state of fill is full when the result is less than a predetermined value, otherwise determining that the state is not full.

4. The carrier tape feeder of claim 1, wherein said calculator estimates the state of fill by performing steps comprising:

determining the carrier tape pitch of the feeder;

counting a number of steps of advancement of the take-up reel drive means between initiation of the rotation of the take-up reel and the signal produced by said sensor over a plurality of cycles;

dividing the number of steps of advancement of the take-up reel drive means by the carrier tape pitch to create a result for each cycle; and determining that the state of fill is full when the result is less than a predetermined value for a predetermined number of consecutive cycles, otherwise determining that the state is not full.

* * * * *